US005575124A

United States Patent [19]

Novello, Jr.

[11] Patent Number: 5,575,124

[45] Date of Patent: Nov. 19, 1996

[54] CONSTRUCTION WITH MODULAR WALLS

[76] Inventor: Eligio Novello, Jr., 53, chemin des Planches, CH - 1066 Epalinges, Switzerland

[21] Appl. No.: 412,953

[22] Filed: Mar. 29, 1995

[51] Int. Cl.[6] ..... E04B 2/14

[52] U.S. Cl. ..... 52/270; 52/762

[58] Field of Search ..... 52/236.6, 236.7, 52/236.9, 264, 265, 266, 270, 271, 239, 455, 456, 474, 784.1, 793.11, 762; 312/117, 245, 246, 298, 351

[56] References Cited

U.S. PATENT DOCUMENTS

| | | | |
|---|---|---|---|
| 3,898,779 | 8/1975 | Tracy | 52/264 |
| 4,114,333 | 9/1978 | Jones et al. | 52/265 |
| 4,187,655 | 2/1980 | Anderson | 52/236.6 |
| 4,615,155 | 10/1986 | Chamberlain | 52/270 X |
| 4,628,650 | 12/1986 | Parker | 52/265 |
| 4,869,036 | 9/1989 | Peacock | 52/474 X |
| 5,177,197 | 1/1993 | del Castillo Von Haucke | 52/236.7 X |
| 5,339,798 | 8/1994 | Christian | 52/265 X |
| 5,359,816 | 11/1994 | Iacouides | 52/265 X |

FOREIGN PATENT DOCUMENTS

| | | | |
|---|---|---|---|
| 4005508 | 8/1991 | Germany | 52/474 |
| 2-30837 | 2/1990 | Japan | 52/474 |
| 6-264533 | 9/1994 | Japan | 52/474 |

*Primary Examiner*—Carl D. Friedman
*Assistant Examiner*—Timothy B. Kang
*Attorney, Agent, or Firm*—Clifford W. Browning; Woodard, Emhardt, Naughton, Moriarity & McNett

[57] ABSTRACT

The present construction includes outer walls, roofs and/or floors in the form of an assembly of modular units. Each modular unit comprises a peripherally closed rectangular supporting frame with intermediate frame elements, several open compartments having all the inner breadth of the supporting frame and having respective heights equal to an integer submultiple of the height of said frame or to an integer multiple of said submultiple. Construction elements including a central embrasure part are arranged in said compartments and at least two facing parts are placed, respectively, on opposite sides of the supporting frame and fixed to the central embrasure part and/or to the supporting frame.

24 Claims, 11 Drawing Sheets

FIG. 12
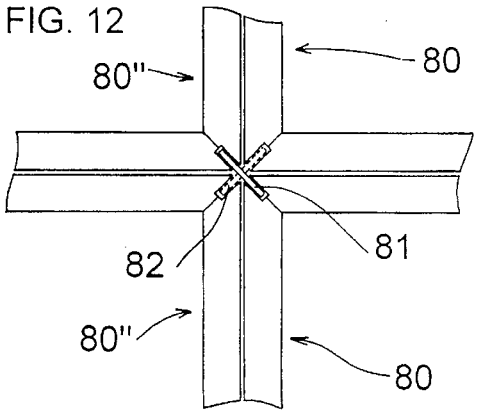
FIG. 9
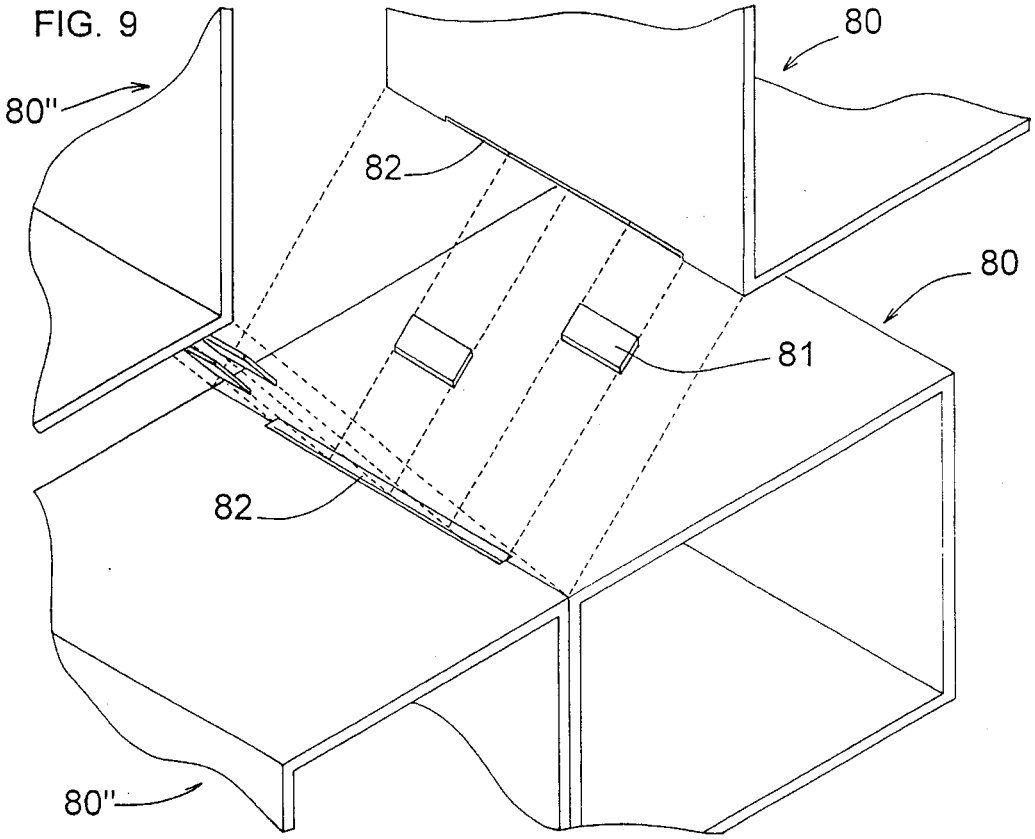
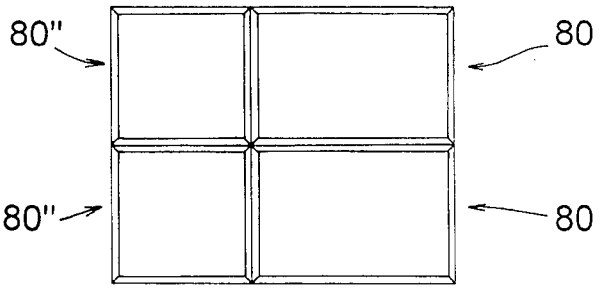
FIG. 10
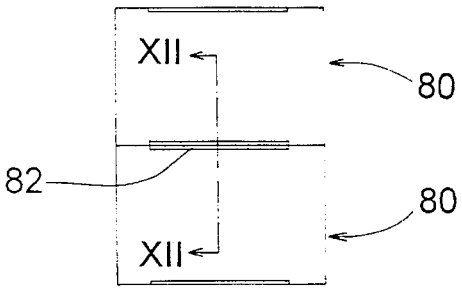
FIG. 11

CONSTRUCTION WITH MODULAR WALLS

SUMMARY OF THE INVENTION

The present invention relates to a construction comprising outer walls and/or roofs and/or floors and/or inner supporting walls or dividing walls and/or furniture elements in the form of an assembly of modular units.

It is an object of the invention to provide a construction composed of elements having dimensions compatible with a supporting structure and being assembled in the same mounting and joining manner with inner and outer adjoining elements and with the supporting structure. The invention aims in particular at providing a construction in which such elements can fulfill all required or desired functions inside or outside the building by complying in particular with physical, static and acoustic conditions which prevail at the level of the outer and inner skins of a building and of upper and lower faces of the floors and roofs. It is another object of the invention to provide a construction in which the elements are removable and interchangeable independently of each other, at all times.

According to the invention, at least one of the modular units for constructing outer walls, roofs, floors or inner supporting walls comprises at least one peripherally closed rectangular supporting frame forming one or, by means of intermediate frame elements fixed to said supporting frame, several open compartments having all the inner breadth of the supporting frame and having respective heights equal to an integer submultiple of the height of said frame or to an integer multiple of this submultiple, and comprises at least one construction element including a central embrasure part arranged in a compartment of the supporting frame, and at least two facing parts placed, respectively, on opposite sides of the supporting frame and fixed to the central embrasure part and/or to said supporting frame.

The supporting frame is preferably made of wood, like the central embrasure part which can comprise a hollow wooden frame or a wooden frame filled with an insulating material. According to a variant, the central embrasure part can comprise a solid insulating block. The wooden frame filled with insulating material can be provided with steam guard means including a steamtight cover sheet.

According to a preferred embodiment, the central embrasure part is fixed to the supporting frame.

The facing parts can include a solid or pigeon-holed facing panel or they can comprise fixed or removable sunshade means or a solar cell panel or a solar collector panel. The facing parts can also comprise a glass or other transparent partition and a frame for the same.

The modular units for constructing inner dividing walls preferably comprise at least one central panel fixed to the floor and to the ceiling by fastening means, and at least two cover elements placed respectively on opposite sides of said central panel and connected to the latter. The central panel can comprise a plate made of alveolate or solid wood and each of said cover elements preferably comprises at least one cover plate.

The furniture elements according to the invention each comprise a peripherally closed rectangular frame having an outer breadth and an outer height respectively equal to integer submultiples of the breadth and height of a central embrasure part or of a compartment of said supporting frame, four furniture elements being arranged so that each one has an edge adjacent to a respective edge of the three other elements, and being removably joined together by means of fastening members assembling adjacent edge portions. Each of said adjacent edge portions preferably comprises a groove forming an angle of 45° with the adjacent surfaces of the furniture element, said fastening members comprising two or more tongue-shaped members, each being inserted in two opposite grooves of the elements to be assembled, the total length of the inserted tongue-shaped elements being equal to the length of the corresponding grooves. According to another embodiment, said fastening members comprise wooden or metallic bolts. Preferably, the rectangular frame of the furniture elements is made of wood, derivatives of wood or synthethic material. The tongue-shaped members can be made of wood, metal or also synthethic material. Said furniture elements are integrated in the walls of the construction, but can also be used independently to form a traditional furniture. They can be used for all house equipments such as kitchen equipments, cupboards, bookcases or bathroom installations.

BRIEF DESCRIPTION OF THE DRAWINGS

Further features of the construction according to the invention, its objects and advantages will more fully appear from the following detailed description of non-limiting exemplary embodiments of said construction, wherein reference is made to the appended drawings, in which:

FIG. 9 is a partially exploded perspective view showing the assembling of four furniture elements;

FIG. 10 is a front view of an assembly of furniture elements according to FIG. 9;

FIG. 11 is a side view of the assembly of FIG. 10;

FIG. 12 is an enlarged detail of a vertical sectional view of an assembly of four furniture elements according to the line XII—XII in FIG. 11.

DETAILED DESCRIPTION

Figure 1:
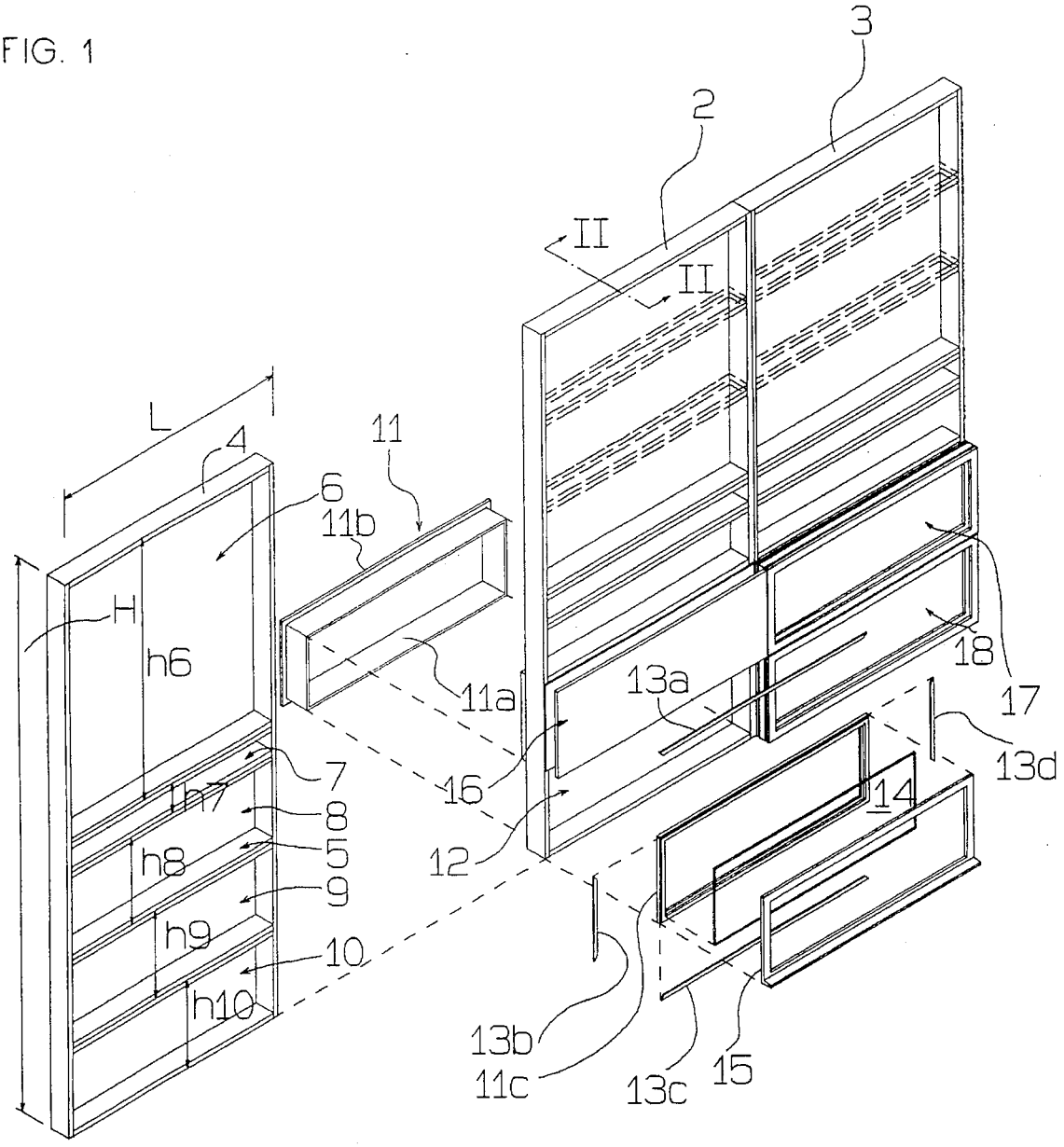
FIG. 1 is a partially exploded perspective view of an outer wall part of a construction according to the invention.

The partially exploded perspective view of FIG. 1 shows an assembly of supporting frames, such as the frames 1, 2, 3 made of wood, each comprising a peripherally closed outer frame structure and intermediate elements such as 5, so as to form open compartments such as 6 to 10. These compartments have all the frame breadth L and respective heights $h_6$ to $h_{10}$, which are integer multiples of a basic height $h_0$, itself equal to an integer submultiple of the height H of the structure 4. In the example of the represented modular unit, $h_7=h_0$, $h_8=h_9=h_{10}=3\ h_0$ and $h_6=9\ h_0$, $h_0$ being equal to H/19.

The supporting frames and their intermediate elements are comprised of rectangular parts having the same section which can be assembled, for example, by means of metallic links, not represented in FIG. 1, such as sheet metal parts bent to form right angles and nailed or screwed to respective corner portions of the frame parts. The frames forming a wall are fixed to each other by fastening means such as screws and are dimensioned so as to comply, once assembled, with the static requirements of the construction.

FIG. 1 illustrates, in relation with frame 2, the arrangement of a construction element 11 principally comprising a central embrasure part 11*a* and two facing parts 11*b* and 11*c*, placed on each side of the supporting frame 2 and assembled with the central part 11*a*.

The construction element 11 represented in this example forms a fixed window, the central part 11*a* having the shape of a box-like frame which will be positioned in a compartment 12 and the outer dimensions of which are substantially equal to the inner dimensions of said compartment. The part 11*b* is formed by a flat frame fixed to an end portion of the central part 11*a*, and the part 11*c* is in this case also formed by a flat frame which will be screwed onto the part 11*a*, once the latter is placed in the compartment 12. The outer dimensions of the frames 11*b* and 11*c* essentially correspond to the outer dimensions of the compartment 12, i.e. to its breadth L and to its height which is equal, for example, to $h_{10}$. Elements 13*a*, 13*b*, 13*c* and 13*d* of an intermediate frame shown separately in FIG. 1, are arranged between the frame 11*c* and the corresponding portions of the supporting frame 2 surrounding the compartment 12, so as to ensure a good insulation and tightness, in particular if the frame 11*c* constitutes an outer facade element of the building. A glass pane 14 is arranged in the frame 11*c* and said pane is maintained by an outer frame 15 screwed at a plurality of locations of its periphery onto the frame 11*c*.

Other construction elements 16, 17, 18 mounted onto the frames 2 and 3 are shown as examples, it being understood that in general all compartments are filled with suitable construction elements according to the desired function. A construction element assembly in a supporting frame constitutes a finished construction unit, juxtaposable to other similar units, so as to form for example an outer wall, a roof, a floor, all of which have been made in a similar manner. The inner and outer parts of each construction element occupy a unitary structural space, the breadth of which is the frame breadth L and the height of which being an integer multiple of the basic height $h_0$. The supporting frames and the construction elements are preferably made of wood, with the exception of the functional parts requiring other materials, and the construction elements are preferably assembled by removable mechanical fastening means, such as screws or clips. Thus, said construction elements are removable without damage after the first assembling and interchangeable in time and in accordance with a desired function.

Figure 2:
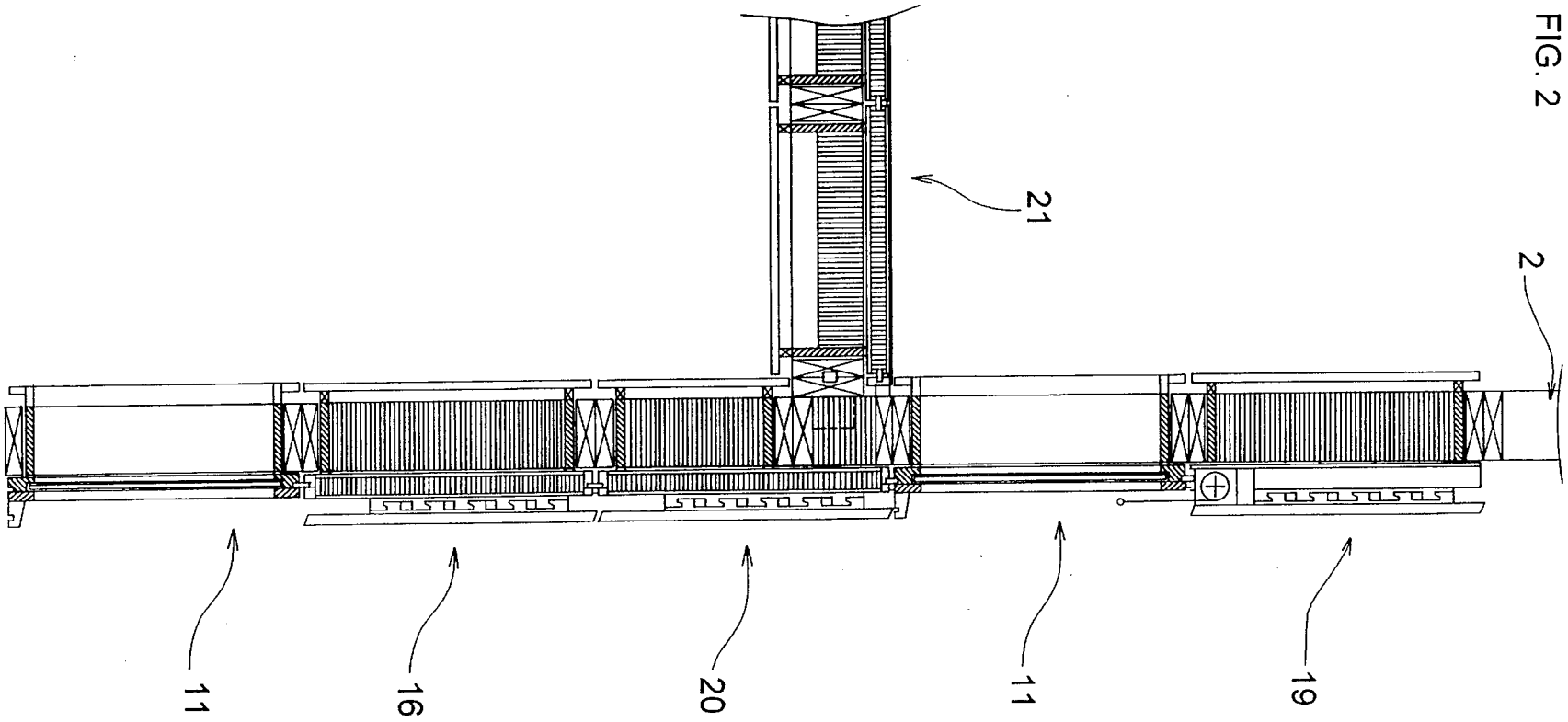
FIG. 2 is a vertical sectional view according to the line II—II in FIG. 1 of an outer wall part provided with various construction elements and connected to a partially visible intermediate floor unit.
Figure 3:
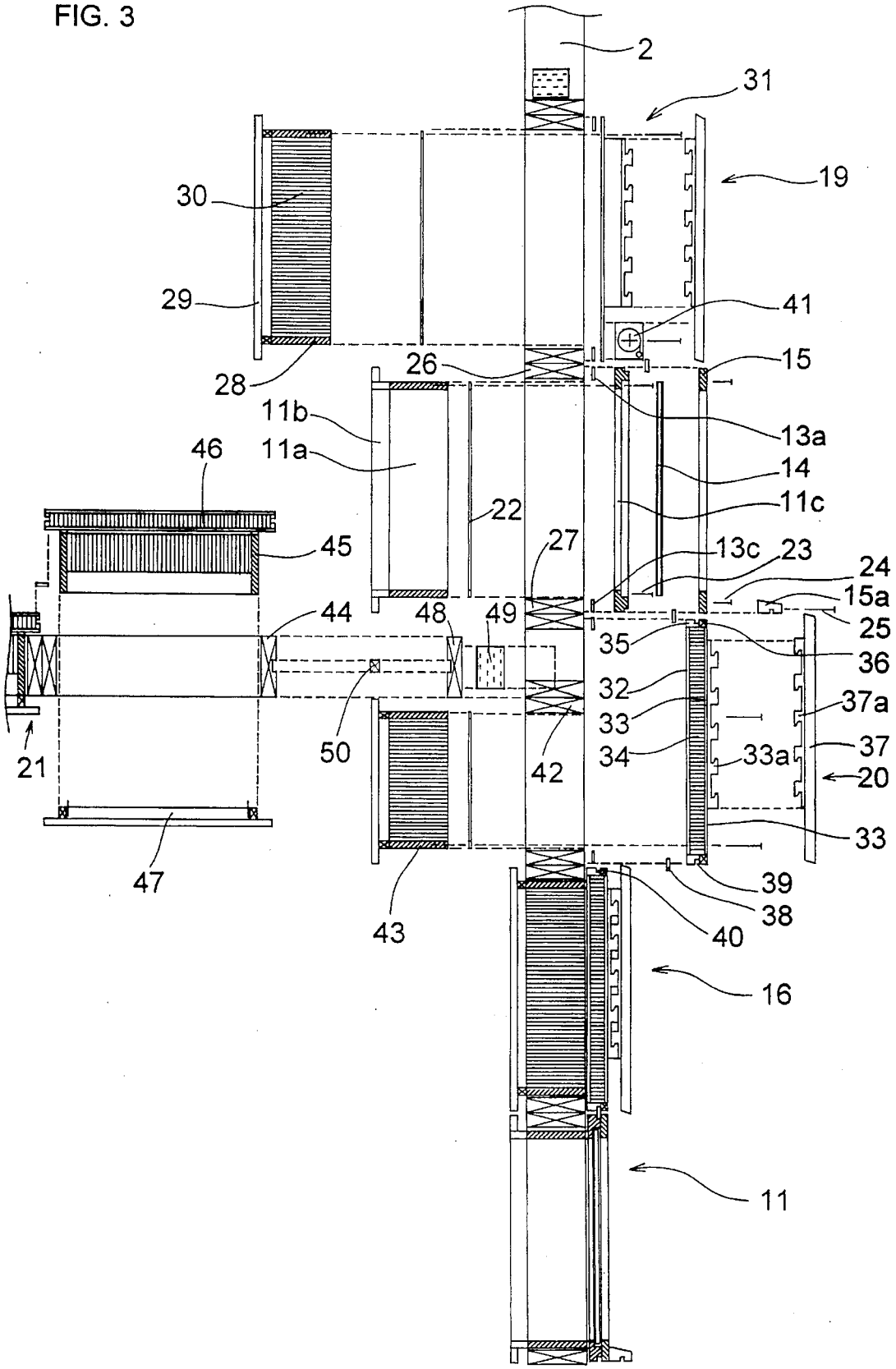
FIG. 3 is an exploded view corresponding to the view of FIG. 2.

FIGS. 2 and 3 show, in a vertical section, an outer wall part and a floor part connected to the latter, comprising different construction elements, the arrangement of which is shown in FIG. 2 and the assembling of which is illustrated by FIG. 3. These elements are inserted in a supporting frame, such as the frame 2, to which is connected a floor part 21.

In the exploded sectional view of the fixed window element 11 in FIG. 3, the parts already mentioned with regard to FIG. 1 are recognizable, namely the central embrasure part 11*a*, the inner facing part in the form of a frame 11*b* assembled with said central part, and the outer facing part comprising the frame 11*c*, the pane 14 and the outer frame or glass maintaining framing 15. A water deflector member 15*a* is fixed onto the lower portion of the framing 15 to protect the rear face of a solid facade element such as 20, situated underneath said framing. A groove on the lower side of the deflector member 15*a* avoids return of streaming water to the ventilated rear face of the element 20.

When the central embrasure part is mounted onto the supporting frame, said part is adjusted by means of liner members, not shown to fix its final position. These liner members can be formed of panels of compressed wood particles which occupy the clearance space provided between the supporting frame and the embrasure part. The remaining interstitial air gap can be assimilated to an insulating stable air sheet. It can also be occupied by a compressible insulating material. Once the part 11*a* is correctly positioned, it is fastened by means of screws to the supporting frame. The frame 11*b* or the frame 11*c* may be fixed to the part 11*a* before that part is fastened to the supporting frame. All these elements being made of wood, the assembling is preferably carried out by screwing, as represented schematically in FIG. 3 by the screws 23, 24, 25. An insulating frame 22 is placed between the frame 11*c* and the embrasure element, and the frame represented by the transversal parts 13*a* and 13*b* is placed between the frame 11*c* and the supporting frame 2, the intermediate elements 26, 27 of the latter determining the height of the corresponding compartment.

A construction element 16 constituting a solid facade element and the variants 19 and 20 of such an element, include an embrasure part 28 in form of a frame, similar to the part 11*a*, to which a first facing part 29 comprising an inner cover plate is fixed. The embrasure part contains in this example an insulating material 30. Alternatively, the embrasure part may be replaced by a solid insulating block. The space between the insulating material or the insulating block and a panel such as 29 comprises a steamtight sheet, not represented, to avoid humidity transmission.

It is to be noted that in the case of an embrasure part as described or a solid insulating block, the mentioned liner members ensure the transmission of forces acting on the plane of the wall, so that said elements serve as wind braces for the construction.

The outer facing part 31 includes a rear facade panel comprised, for example, of an assembly of two supporting plates 32, 33 between which a layer of insulating material 34 can be placed and fixed. The two supporting plates are made integral with frame part 35, assembled for example by screwing or nailing with frame part 36. The outer supporting plate 33 bears a vertical bar provided with hooks 33*a* designed so as to cooperate with a complementary bar provided with hooks 37*a* integral with an outer cover panel 37. The arrangement of said bars and in particular the hook angles are chosen so that when the cover panel is mounted—in invisible manner—by hooking, said panel is pushed in direction of the rear facade panel and maintained by gravity.

A sealing member, such as 38, is provided between the outer facing parts of two adjoining construction elements, said sealing member, being inserted in corresponding grooves 39, 40 of two adjoining panels. This allows the disassembling of each panel independently of the others by separation of the frames 35 and 36.

The construction element 19 comprises a rear facade panel shorter than the corresponding structural space, so as to allow the placing of an antisolar roller blind indicated by 41, above the fixed window element 11.

The variant of a construction element indicated by 20 comprises a central embrasure part less high than the outer part of this element, the supporting frame being provided with an intermediate element 42 to form a housing for this embrasure part 43, otherwise similar to the embrasure part described in relation with element 19. The height of the compartment corresponding to the element 20 is thus divided in a ratio of two thirds/one third, the upper third being used for the connection of the floor unit 21.

The floor unit 21 is made in a manner similar to a wall unit and comprises in particular a supporting frame 44 as well as construction elements comprising a central embrasure part 45, provided on each side with facing parts forming, on the one side, floor elements 46 and on the opposite side, ceiling elements 47. The supporting frame 44 is connected to the supporting frame 2 by means of an intermediate element 48 fixed onto this frame, for example by means of metallic links, such as the schematically represented link 49. A connection bar 50 is inserted in corresponding grooves of the frame elements 44 and 48.

Figure 4:
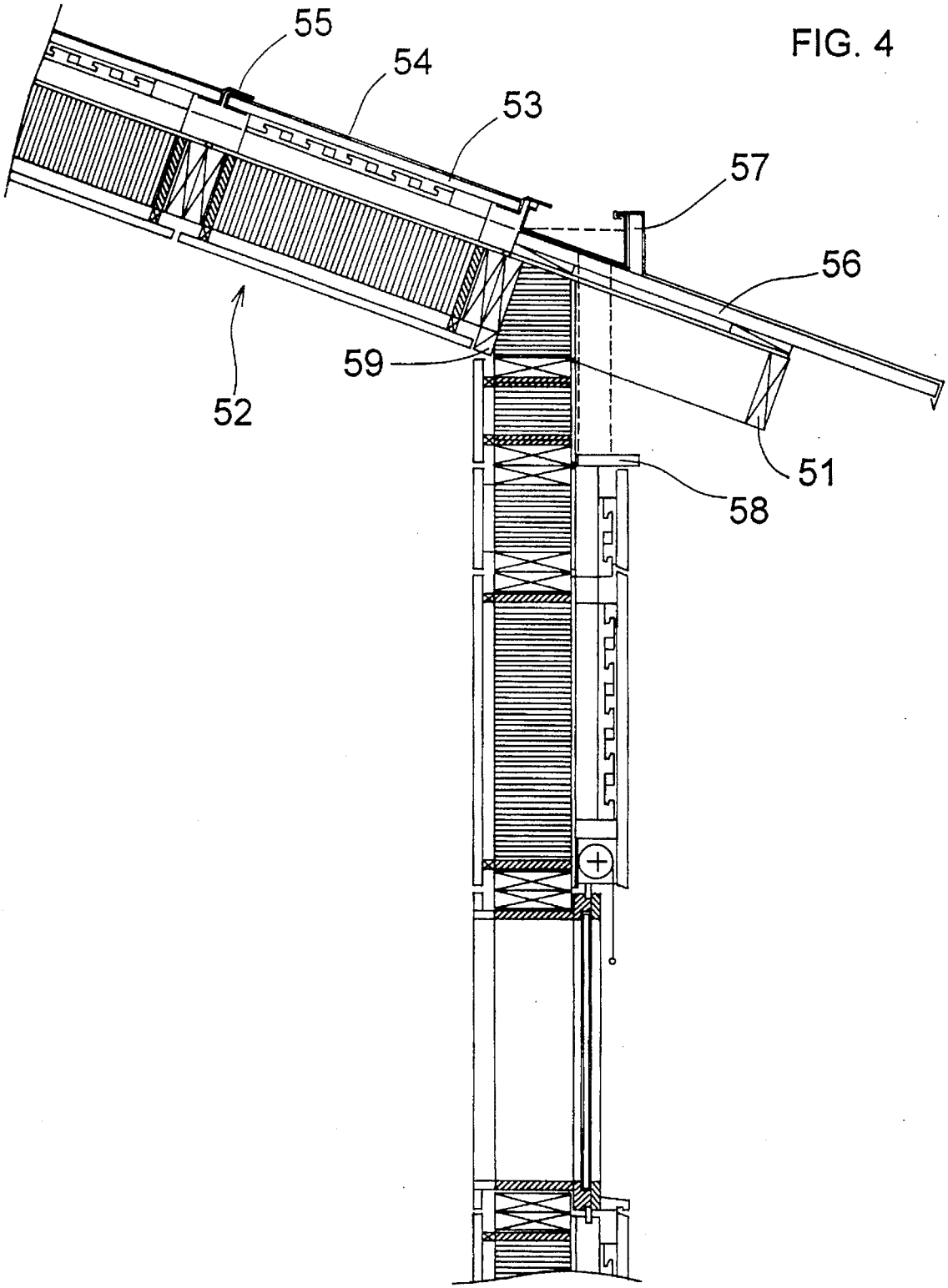
FIG. 4 is a vertical sectional view similar to that of FIG. 2, showing an outer wall part connected to a roof part.

FIG. 4 shows a roof unit essentially constructed in the same manner as the above described wall and floor units. It comprises a frame 51 forming compartments, such as 52, provided with construction elements which can have a structure similar to wall construction elements, such as 19. An outer panel 53 is covered with a thin metallic sheet 54 bent back on three sides and extending on one side, such as shown at 55, over the panel, to ensure overlapping with the lower roof element. This overlapping contributes, as in the case of a roof with normal tiles, to the maintenance of the panels against a suction effect due to the wind, while a double movement has to be exerted to remove a panel, i.e. a movement in direction of the top of the inclined roof plane and a movement perpendicularly to the same.

The roof construction elements can be, for example, solid panel elements, window elements or elements comprising a solar collector or solar cells having the same dimensions.

As shown in FIG. 4, the outer compartment of the frame 51 is covered with a plate 56 provided with an element 57 forming a gutter wall, the width of said plate being superior to the width of said compartment. The assembly 56, 57 is further covered with a metallic protection sheet. End elements 58 and 59 are provided to close corresponding inner and outer facing parts. The connection of the frames 51 and 2 is realized by abutment, metallic links or by any other appropriate means.

Figure 5:
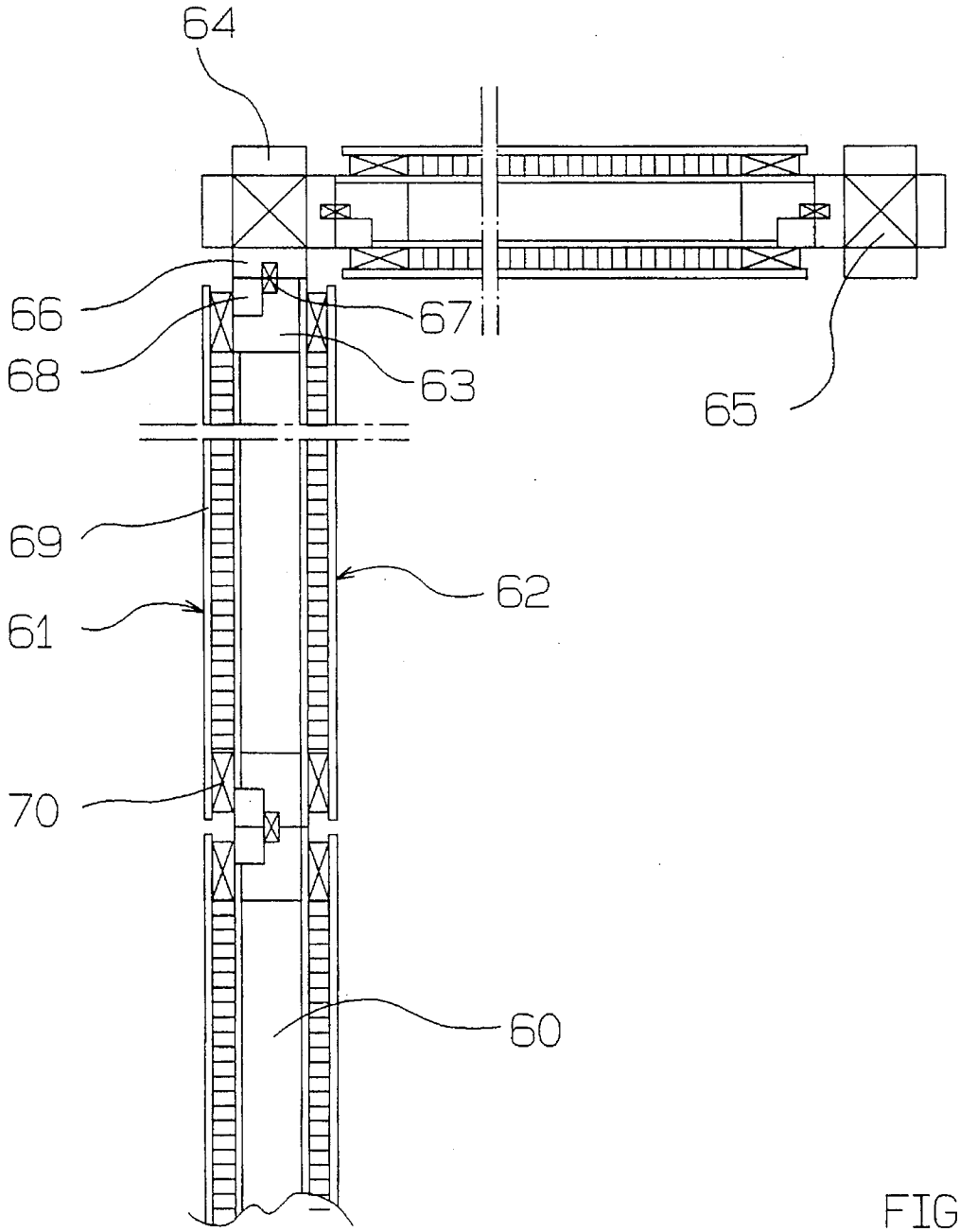
FIG. 5 is a horizontal sectional view of a portion of an inner dividing wall of a construction according to the invention.
Figure 6:
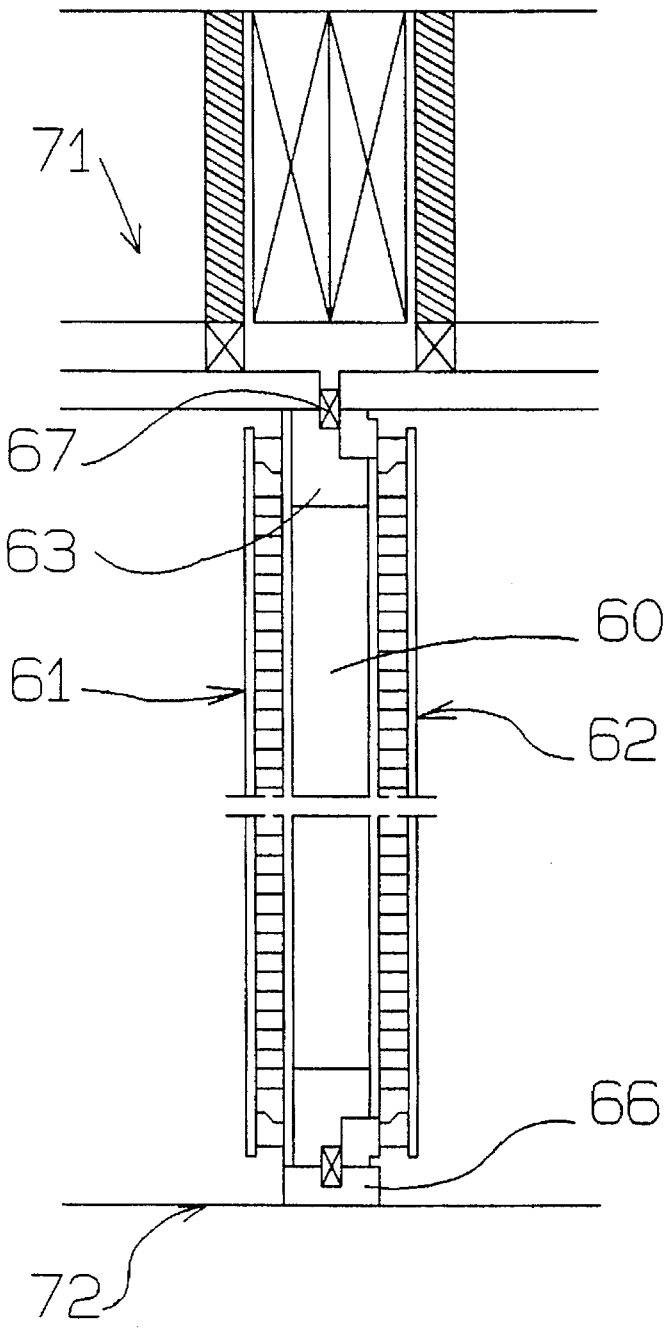
FIG. 6 is a vertical sectional view of a dividing wall according to FIG. 5.
Figure 7:
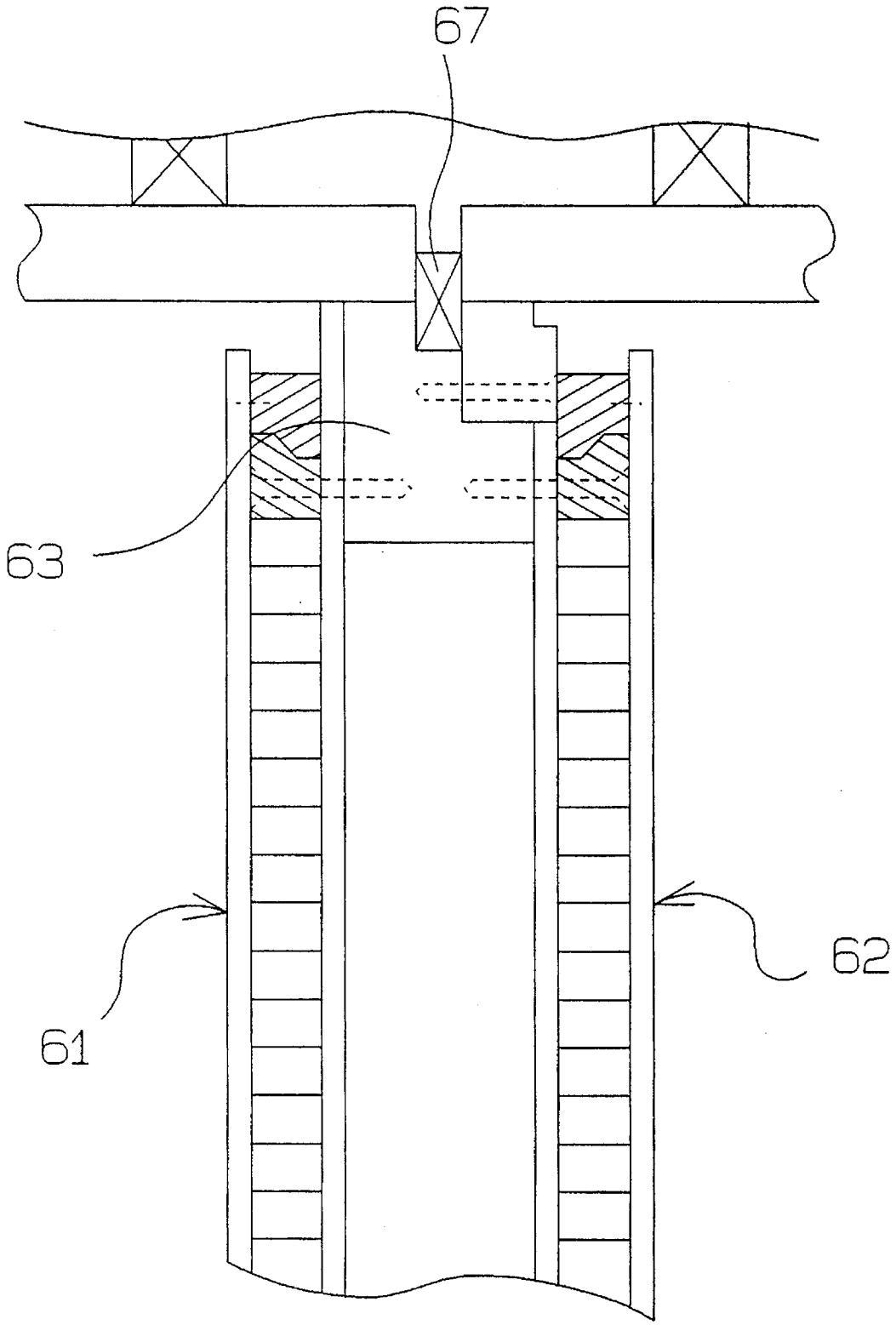
FIG. 7 is an enlarged detail of FIG. 6.

FIGS. 5, 6 and 7 show inner dividing wall construction units comprising, in a general manner, a central panel 60 provided on each side with cover elements 61, 62. The central panel ensures wall rigidity and stability and can be comprised of a plate made of solid or alveolate wood which can be bordered with a stepped portion, directly shaped on the central panel or, as represented in FIGS. 5 and 6, on intermediate parts 63 integral with the panel.

FIG. 5 shows, in a horizontal section, inner wall parts connected, for example, to posts such as 64, 65. Said posts are provided with fastening bars, such as 66, having a U-shaped cross section, tongue member or sealing bars 67 being inserted up to half of their width in the groove of the U. The posts can also have U-shaped grooves made therein. The stepped part 63 forming a frame integral with the central panel 60, leans against one side of the tongue member projecting beyond the bar 66; A maintaining frame part 68 fits into part 63 and is fixed, for example by screwing, onto the same. As shown in FIG. 6, which is a vertical sectional view of an inner wall part, the latter is fixed to a ceiling 71 and to a floor 72 in a manner similar to the lateral fixation described with regard to FIG. 5. Thus, intermediate parts such as 63 extend on the whole periphery of each inner wall element, as do the maintaining frame parts 68 cooperating with continuous joining bars or tongue members 67. Similar fastening parts are indicated by the same reference numbers in FIGS. 5 to 7.

The central panel 60 is provided on each side with cover elements comprised, for example, of thin plates made of solid wood, of wood derivatives or of plastics, 69, mounted onto a wooden frame 70. Said frame consists of bars which can be sticked or screwed onto the cover plate. The empty space in the frame can be filled with an insulating material ensuring in particular an acoustic insulation.

As it is shown in FIGS. 6 and 7, the cover plate with its frame is suspended by means of a bar provided with hooks on a complementary shaped bar fixed onto the central panel, in the same manner as the wall panels 37. Other fastening means can be used, for example clips or press buttons.

The cover plates are thus interchangeable without requiring dismounting of the central panel. As FIG. 5 shows, negative joints are formed between two adjoining cover plates.

Figure 8:
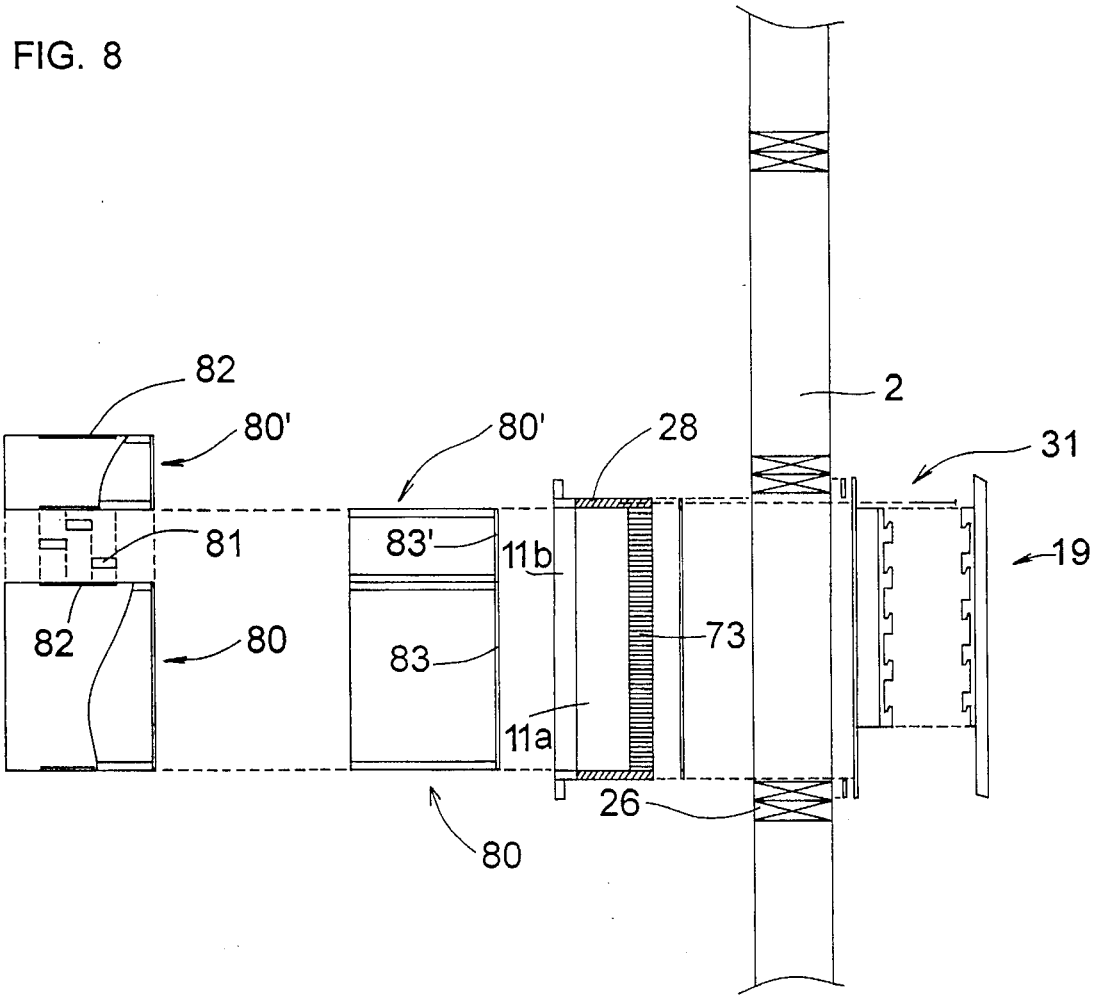
FIG. 8 is an exploded vertical sectional view of a wall part provided with furniture elements.

FIG. 8 shows, in an exploded view, the insertion, in an embrasure part 28, of furniture elements having the shape of peripherally closed rectangular frames, such as the frames 80, 80'. The embrasure part includes, in this example, on the portion turned to the outside of the facade, a layer 73 of insulating material, the frames 80, 80' being provided, for example, with bottom parts 83, 83' which will be positioned near this insulating layer.

Figure 13:
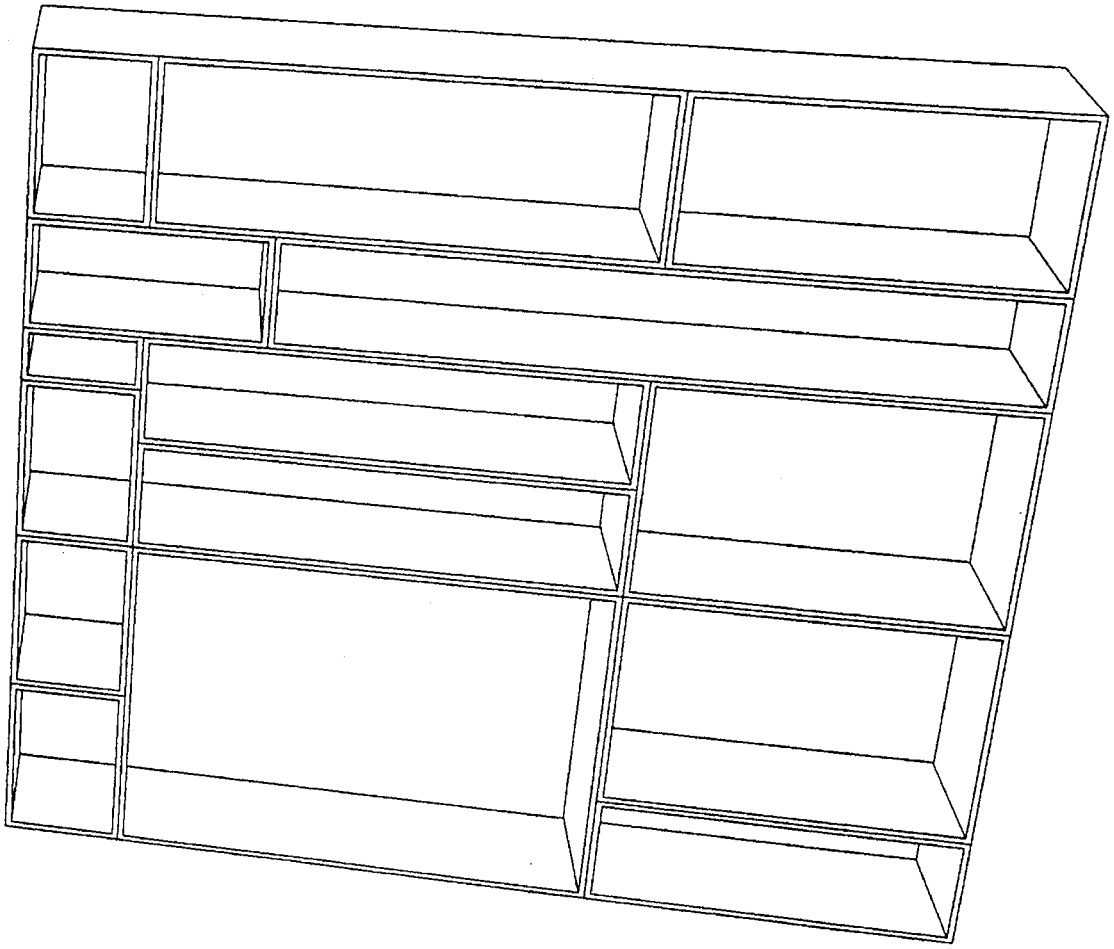
FIGS. 13 and 14 are perspective views of two embodiments of an independent furniture assembly.

In the examples of FIG. 8 and of FIGS. 9 to 12, four elements 80, 80' or 80, 80" are assembled with each other before being placed in the embrasure part. The assembling is made by means of tongue member 81 inserted in grooves, such as 82, provided in the furniture element edges, as shown in more detail in FIGS. 9 and 13. Said grooves are orientated so as to form an angle of 45° with the adjacent furniture element surfaces and have a length which is an integer multiple of the length of the tongue members 81. For example two, three or four tongue members are arranged cross wise in the four grooves formed at the common edge of four assembled furniture elements. Said grooves determine the positions of the furniture elements with respect to each other in the direction of their depth. When the members 81 are placed, as shown in FIG. 9, and the furniture elements are assembled accordingly, said elements are rendered integral in the direction of their length, their width and their depth and can be separated only by a movement in an angle of 45° with respect to their surfaces.

Figure 14:
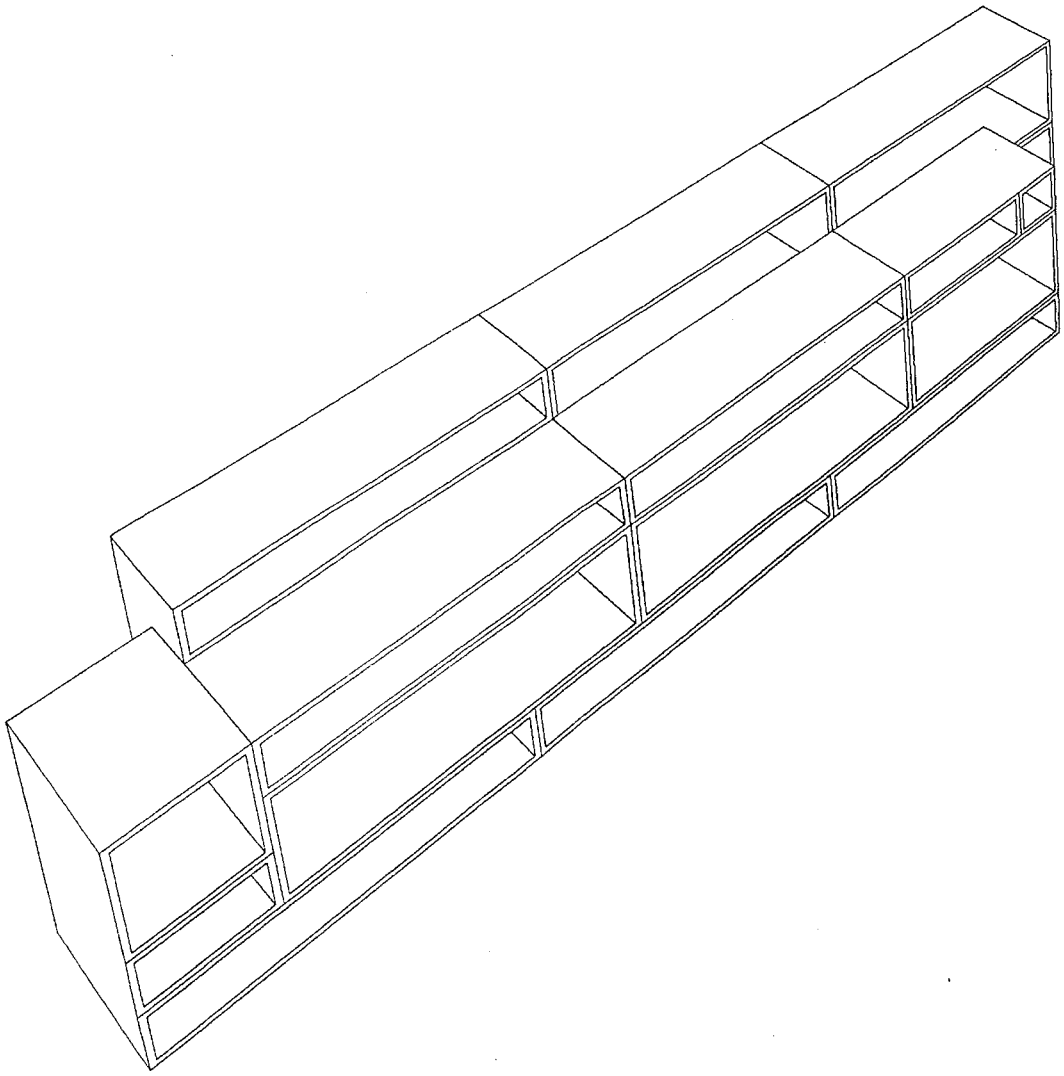

FIGS. 10 and 11 show, in side view and in front view, an assembly of two elements 80 and two elements 80" which can be inserted in a corresponding embrasure part. Of course, these furniture elements can have all functions compatible with their outer shape and also be used as inner facing elements, the wall serving as bearing structure, directly or through the corresponding embrasure parts which can belong, for example, to windows or niches. The same mounting principle assembling the furniture elements can also be used to make independent items of furniture, as shown, for example, in FIGS. 13 and 14. In each case, a furniture element can comprise a wall, a door, a glass partition or any other equipment permitting an assembling with the rectangular frame of such an element.

Thus, the present construction comprises modular units for forming walls, roofs, floors or inner supporting or dividing walls. The assembling and fastening mode of the different construction elements follows the same principle, i.e. mounting of three basic parts, a central part and two facing parts arranged on each side of the central part in a supporting structure, so that said supporting structure is sandwiched between said facing parts assembled with the central part. The particular assembly such as described, is not only particularly simple, but also provides an interchangeability of the construction elements with respect to the supporting structure, said construction elements being independent with respect to the supporting frame and independent from each other. Thus, it is possible to modify the construction at all times by replacing construction elements by elements having different functions, all these elements being compatible. In other words, a solid wall part can become a window or a door and inner or outer coatings can be replaced by different elements occupying the same field. Furthermore, the construction elements can advantageously serve as support for furniture or inner equipment elements, particularly for furniture elements such as described above.

The invention claimed is:

1. A construction for outer walls, roofs, floors, and inner supporting walls comprising an assembly of independent modular units, each modular unit comprising a peripherally closed rectangular supporting frame forming one or, by means of intermediate frame elements fixed to said supporting frame, several open compartments having all the inner breadth of the supporting frame and having respective heights equal to an integer submultiple of the height of said frame or to an integer multiple of said submultiple, and comprising at least one construction element including a central embrasure part arranged in said compartment of said supporting frame, and at least two facing parts placed, respectively, on opposite sides of said supporting frame and assembled with said central embrasure part, said facing parts having an outer breadth and an outer height which are substantially equal to the outer breadth and height of said compartment.

2. A construction according to claim 1, wherein said supporting frame is made of wood.

3. A construction according to claim 1, wherein said central embrasure part is a hollow frame made of wood.

4. A construction according to claim 1, wherein said central embrasure part comprises a solid insulating block.

5. A construction according to claim 1, wherein said central embrasure part comprises a wooden frame filled, at least in part, with an insulating material.

6. A construction according to claim 5, wherein said wooden frame of the central embrasure part is provided with steam guard means comprising a steamtight cover sheet.

7. A construction according to claim 1, wherein said central embrasure part is fixed to said supporting frame.

8. A construction according to claim 1, wherein at least one of said facing parts is a solid or pigeon-holed facing panel.

9. A construction according to claim 1, wherein at least one of said facing parts comprises a solar cell panel or a solar collector panel.

10. A construction according to claim 1, wherein at least one of said facing parts comprises a transparent partition and a fixed or movable frame for the same.

11. A construction according to claim 1 having at least one inner dividing wall, wherein said dividing wall comprises, at least one central panel fixed to the floors, to the ceiling and/or to structural parts of the construction or of said dividing wall by fastening means, and at least two cover elements placed, respectively, on opposite sides of said central panel and connected to the latter, said fastening means comprising a border part or portion of said central panel, a maintaining part removably connected to said border part or portion, and a fastening member connected to said floor, ceiling or structural parts, a portion of said fastening member being arranged for being inserted between said border part or portion and said maintaining part in such a manner that said central panel can be mounted and removed by being moved only in a direction perpendicular to said dividing wall.

12. A construction according to claim 11, wherein said central panel comprises a plate of alveolate or solid wood.

13. A construction according to claim 11, wherein said fastening means comprise at least one elongated member forming a groove of U-shaped cross section and at least one tongue-shaped member partially inserted in groove, said central panel or an intermediate part integral with said panel having a stepped border portion leaning against a first side of a protruding portion of said tongue-shaped member, an elongated maintaining member being fixed to said stepped border portion, so as to lean against said tongue-shaped member on a side opposite to said first side.

14. A construction according to claim 11, wherein said fastening means comprise an elongated fastening member having at least one portion protruding in the plane of said central panel, said central panel or an intermediate part integral with said panel having a stepped border portion leaning against a first side of said protruding portion of said fastening member, an elongated maintaining member being fixed onto said stepped border portion so as to lean against said protruding portion on a side opposite to said first side.

15. A construction according to claim 11, wherein said cover elements comprise each at least one cover plate.

16. A construction according to claim 15, wherein said cover plate is mounted onto said central panel, so as to provide a space between the inner surface of said cover plate and said central panel, said space being filled with an acoustic insulating material.

17. A construction according to claim 11, wherein said cover elements are suspended on elongated supporting members having a hook-shaped cross-section and being fixed onto said central panel.

18. A construction according to claim 11, wherein said structural part of said dividing wall comprises a border part or portion of a central panel adjacent to said central panel.

19. A construction according to claim 1, comprising furniture elements, wherein each furniture element comprises a peripherally closed rectangular frame having an outer breadth and an outer height equal to a respective integer submultiple of the breadth and height of a corresponding central embrasure part or of a corresponding compartment of said supporting frame, four furniture elements being arranged so that each one has one edge adjacent to a respective edge of the three other elements, said four furniture elements being removably joined together by means of fastening members connected to adjacent edge portions of said furniture elements.

20. A construction according to claim 19, wherein each of said edge portions comprises a groove forming an angle of 45° with the adjacent surfaces of the furniture element, said fastening members comprising two or more tongue-shaped members, each inserted in two opposite grooves of the furniture elements to be assembled, the total length of said tongue-shaped members inserted in said grooves being equal to the length of the corresponding grooves.

21. A construction for outer walls, roofs, floors, and inner supporting walls comprising an assembly of independent modular units, each modular unit comprising a peripherally closed rectangular supporting frame forming one or, by means of intermediate frame elements fixed to said supporting frame, several open compartments having all the inner breadth of the supporting frame and having respective heights equal to an integer submultiple of the height of said frame or to an integer multiple of said submultiple, and comprising at least one construction element including a central embrasure part arranged in said compartment of said supporting frame, and at least two facing parts placed, respectively, on opposite sides of said supporting frame and assembled with said central embrasure part, said facing parts having an outer breadth and an outer height which are substantially equal to the outer breadth and height of said compartment; said construction further comprising furniture elements, wherein each furniture element comprises a peripherally closed rectangular frame having an outer breadth and an outer height equal to a respective integer submultiple of the breadth and height of a corresponding central embrasure part or of a corresponding compartment of said supporting frame, four furniture elements being arranged so that each one has one edge adjacent to a respective edge of the three other elements, said four furniture elements being removably joined together by means of fastening members connected to adjacent edge portions of said furniture elements; wherein each of said edge portions comprises a groove forming an angle of 45° with the adjacent surfaces of the furniture element, said fastening members comprising two or more tongue-shaped members, each inserted in two opposite grooves of the furniture elements to be assembled, the total length of said tongue-shaped members inserted in said grooves being equal to the length of the corresponding grooves.

22. A construction according to claim 21, wherein said fastening members comprise wooden or metallic bolts.

23. A construction according to claim 21, wherein said rectangular frame is made of wood, derivatives of wood or synthetic material.

24. A construction according to claim 21, wherein said tongue-shaped members are made of wood, metal or synthetic material.

* * * * *

UNITED STATES PATENT AND TRADEMARK OFFICE

CERTIFICATE OF CORRECTION

PATENT NO. : 5,575,124
DATED : November 19, 1996
INVENTOR(S) : Eligio Novello, Jr.

It is certified that error appears in the above-indentified patent and that said Letters Patent is hereby corrected as shown below:

In column 2, line 63, please insert --4-- after "structure".

In column 5, line 64, please delete the ";" and insert in lieu thereof --.--.

In column 7, line 64, please delete "floors" and insert in lieu thereof --floor--.

Signed and Sealed this
Eighth Day of April, 1997

Bruce Lehman

*Attest:*

BRUCE LEHMAN

*Attesting Officer*

*Commissioner of Patents and Trademarks*